United States Patent [19]

Inoue et al.

[11] Patent Number: 4,539,291

[45] Date of Patent: Sep. 3, 1985

[54] DIRECT POSITIVE SILVER HALIDE PHOTOGRAPHIC MATERIALS

[75] Inventors: Nobuaki Inoue; Hiroyuki Mifune; Koki Nakamura, all of Kanagawa, Japan

[73] Assignee: Fuji Photo Film Co., Ltd., Kanagawa, Japan

[21] Appl. No.: 562,628

[22] Filed: Dec. 19, 1983

[30] Foreign Application Priority Data

Dec. 24, 1982 [JP] Japan ..... 57-229552
Dec. 24, 1982 [JP] Japan ..... 57-229553

[51] Int. Cl.[3] ..... G03C 1/36

[52] U.S. Cl. ..... 430/597; 430/596; 430/598; 430/940; 430/606

[58] Field of Search ..... 430/597, 596, 598, 940, 430/606

[56] References Cited

U.S. PATENT DOCUMENTS

| | | | |
|---|---|---|---|
| 3,035,917 | 5/1962 | Fry et al. | 430/597 |
| 3,124,458 | 3/1964 | Fry et al. | 430/597 |
| 3,184,313 | 5/1965 | Rees et al. | 430/606 |
| 3,326,687 | 6/1967 | Kalenda | 430/606 |
| 3,403,025 | 9/1968 | Rees et al. | 430/606 |
| 3,658,547 | 4/1972 | Shiba et al. | 430/606 |
| 3,945,832 | 3/1976 | Shiba et al. | 430/598 |

*Primary Examiner*—Won H. Louie
*Attorney, Agent, or Firm*—Sughrue, Mion, Zinn, Macpeak & Seas

[57] ABSTRACT

A direct positive silver halide material is disclosed. The material is comprised of a support base having a silver halide emulsion layer thereon which contains at least one phenazine series compound represented by the general formula (I), (II) or (III) and at least one compound represented by the general formula (IV), (V) or (VI). The structural formulae are shown within the specification wherein their substituents are defined. By including one compound of each of these groups within the material the resulting material provides images with a reduced minimum density without reducing the contrast of the images formed.

11 Claims, No Drawings

DIRECT POSITIVE SILVER HALIDE PHOTOGRAPHIC MATERIALS

FIELD OF THE INVENTION

This invention relates to silver halide photographic materials and, more particularly, to direct positive silver halide photographic materials.

BACKGROUND OF THE INVENTION

When a silver halide light-sensitive material is exposed to light including the light of a light-sensitive wavelength region for said light-sensitive material and developed, the photographic density or blackening density increases as the amount of exposure increases until it reaches a maximum value. When the amount of exposure is further increased, the photographic density begins to decrease to form, finally, a positive image. Such a phenomenon is generally called solarization. Also, in a silver halide emulsion which is optically or chemically fogged in the production step of the silver halide emulsion, a similar reversal phenomenon by light occurs. The direct positive silver halide photographic emulsion in this invention is the latter type photographic emulsion, that is, a photographic silver halide emulsion which is previously optically or chemically fogged so that the emulsion forms a positive image after ordinary light exposure and ordinary development.

A previously fogged direct positive silver halide photographic emulsion frequently cannot obtain a sufficiently low minimum density (e.g., a pure white portion is not obtained) with a conventional technique to reduce the contrast of images. Accordingly, sufficient image quality cannot be obtained.

In order to reduce the minimum density, a desensitizing compound is used. However, since conventional desensitizing compounds frequently reduce the maximum density simultaneously when they reduce the minimum density, the use of such conventional densensitizing compounds is frequently accompanied by a reduction in contrast and frequently causes an undesirable phenomenon for photographic image quality. In the field of graphic arts requiring particularly high contrast, the development of a photographic light-sensitive material which can reduce the reversal minimum density without reducing contrast has been strongly desired.

SUMMARY OF THE INVENTION

A primary object of this invention is, therefore, to provide a direct positive silver halide photographic material which gives the reduced minimum density without reducing the contrast of images formed.

As a result of the present inventors' various investigations, it has been discovered that the foregoing object of this invention is achieved by a combination of at least one of phenazine series compounds represented by the following general formula (I), (II) or (III) and at least one of the compounds represented by the following general formula (IV), (V) or (VI):

General Formula (I)

-continued

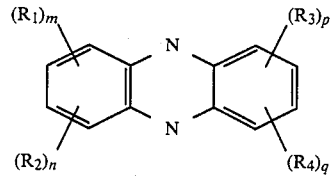

General Formula (II)

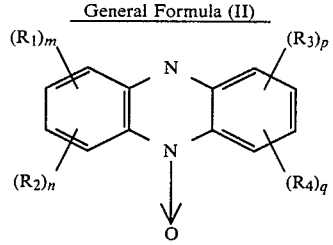

General Formula (III)

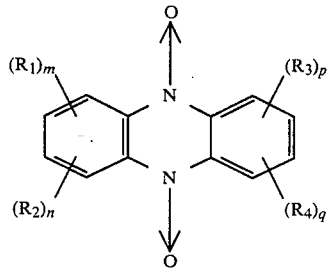

wherein $R_1$ to $R_4$ which may be the same or different, each represents a hydrogen atom, an alkyl group (having, preferably, 1 to 4 carbon atoms, such as a methyl group, an ethyl group, a propyl group, a butyl group, a t-butyl group, etc.), an aryl group (having, preferably, 6 to 10 carbon atoms, such as a phenyl group, a naphthyl group, a tolyl group, etc.), a halogen atom (a chlorine atom, a bromine atom, an iodine atom, etc.), an alkoxy group (having, preferably, 1 to 4 carbon atoms, such as a methoxy group, an ethoxy group, etc.), a hydroxy group, an acylamino group (having, preferably, 1 to 4 carbon atoms, such as a formylamino group, an acetamino group, etc.), a carboxy group, a nitro group, or a cyclic hydrocarbon group condensed to a benzene ring (e.g.,

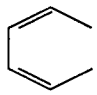

etc.) and m, n, p and q each represents 1, 2 or 3.

General Formula (IV)

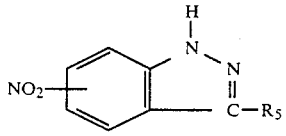

wherein $R_5$ represents a hydrogen atom or an alkyl group (having, preferably, 1 to 5 carbon atoms, such as a methyl group, an ethyl group, a propyl group, a t-butyl group, a pentyl group, etc.) and $NO_2$ is positioned at the 5-position, 6-position, or 7-position.

General Formula (V)

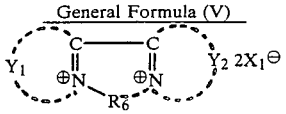

wherein $Y_1$ and $Y_2$, which may be the same or different, each represents a non-metallic atomic group necessary for completing a pyridine ring, a benzothiazole ring, or a benzimidazole ring; said $Y_1$ and $Y_2$ may combine with each other to form a 1,10-phenanthroline ring; $R_6$ represents $-(CH_2)_{m_1}$ (wherein $m_1$ represents 2, 3 or 4), —CH=CH—, or

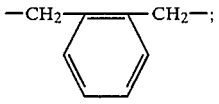

and $X_1$ represents an anion.

General Formula (VI)

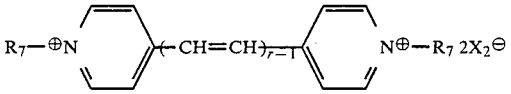

wherein $R_7$ represents an alkyl group (having, preferably, 1 to 20 carbon atoms, such as methyl group, an ethyl group, a propyl group, an octyl group, a decyl group, a dodecyl group, an octadecyl group, etc.); $X_2$ represents an anion; and r represents 1 or 2.

That is, according to this invention, there is provided a direct positive silver halide photographic emulsion containing at least one of the compounds represented by the foregoing general formula (I), (II) or (III) and at least one of the compounds represented by the foregoing general formula (IV), (V) or (VI).

DETAILED DESCRIPTION OF THE INVENTION

As described above, the present invention involves using a combination of a phenazine series compound shown by general formula (I), (II) or (III) described above and a compound shown by general formula (IV), (V) or (VI) described above. Compounds of the foregoing general formula (IV), (V) or (VI) provide almost no influence on the minimum density of a direct positive silver halide emulsion by themselves. Accordingly, it is an unexpected effect that a combination of a phenazine series compound shown by general formula (I), (II) or (III) and a compound shown by general formula (IV), (V) or (VI) would greatly reduce the reversal minimum density in a direct positive silver halide emulsion.

The compounds used in this invention will now be explained in detail.

In general formula (I), (II) or (III) described above, $R_1$ to $R_4$ each represents a hydrogen atom, an alkyl group, an aryl group, a halogen atom, an alkoxy group, a hydroxy group, an acylamino group, a carboxy group, a nitro group, or a cyclic hydrocarbon condensed to a benzene ring as described above. $R_1$ to $R_4$ are preferably a hydrogen atom, an alkyl group, a halogen atom, an alkoxy group, a nitro group, or a hydroxy group, more preferably a hydrogen atom, an alkyl group or an alkoxy group.

Practical examples of the compounds shown by general formulae (I), (II) and (III) are shown below but the compounds used in this invention are not limited to them.

Compounds of General Formula (I)

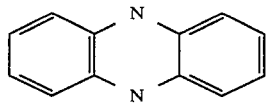

(I)-1

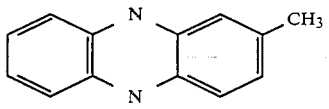

(I)-2

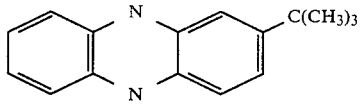

(I)-3

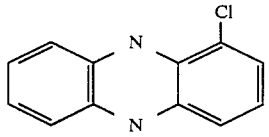

(I)-4

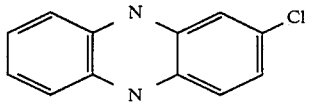

(I)-5

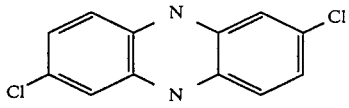

(I)-6

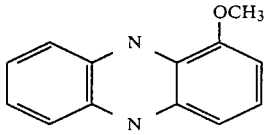

(I)-7

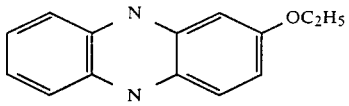

(I)-8

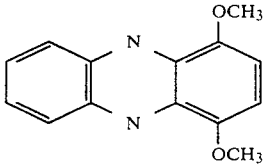

(I)-9

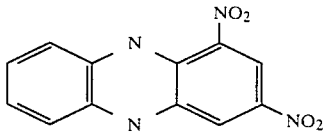

(I)-10

Compounds of General Formula (II)

-continued (II)-2

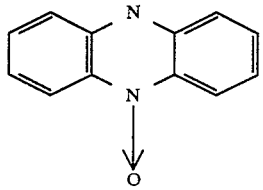

(II)-2

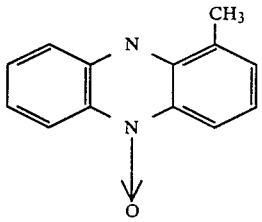

(II)-3

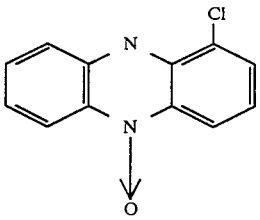

(II)-4

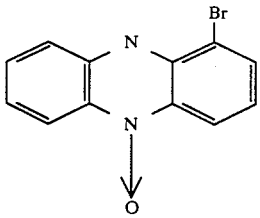

(II)-5

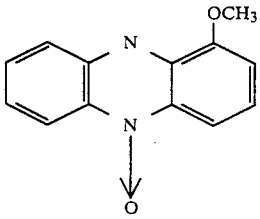

(II)-6

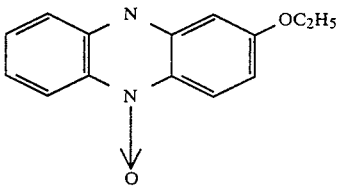

(II)-7

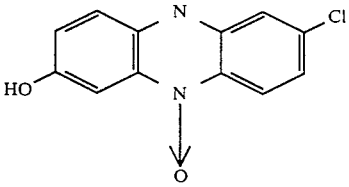

-continued (II)-8

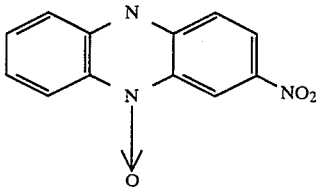

Compounds of General Formula (III)

(III)-1

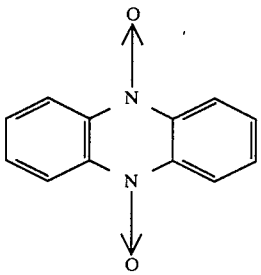

(III)-2

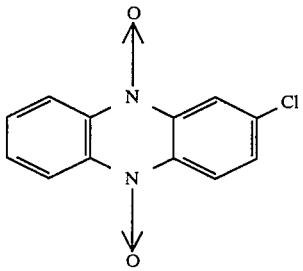

(III)-3

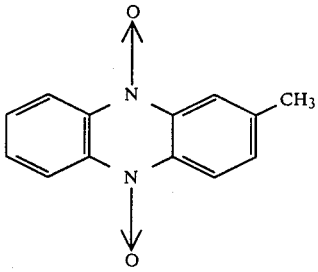

(III)-4

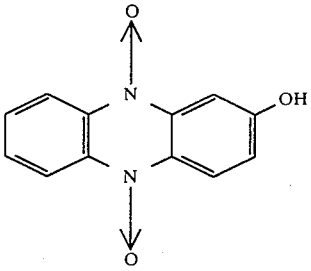

The compounds shown by general formulae (I), (II) and (III) are known compounds and hence are easily available or can be produced by known methods as described in, for example, Japanese Patent Publication No. 8746/72, etc.

The compound of general formula (I), (II) or (III) is used in a range of 5 mg to 500 mg, in particular 20 mg to 200 mg per mole of silver halide in a direct positive silver halide emulsion layer.

The compounds shown by general formulae (IV), (V) and (VI) will now be explained in detail.

Practical examples of the compound shown by general formula (IV) are as follows but the compounds of general formula (IV) used in this invention are not limited to them.

(IV)-1

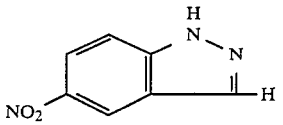

(IV)-2

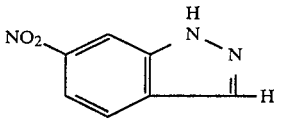

(IV)-3

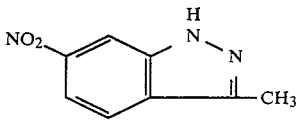

$X_1$ and $X_2$ in general formulae (V) and (VI), respectively, represent an anion and examples of the anion are a halogen ion, a nitrate ion and a sulfate ion.

Practical examples of the compound shown by general formula (V) are as follows.

(V)-1

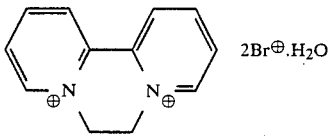

(V)-2

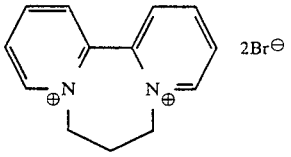

(V)-3

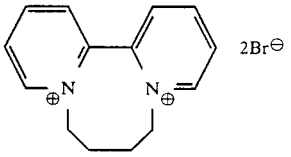

-continued (V)-4

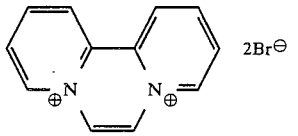

(V)-5

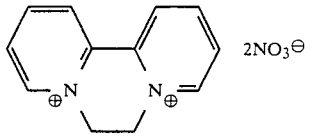

(V)-6

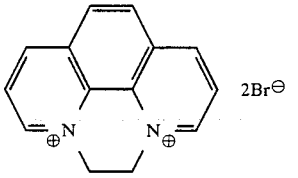

(V)-7

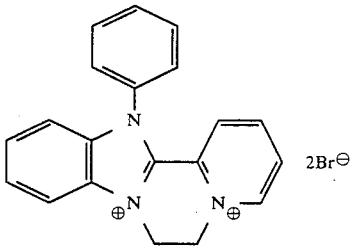

(V)-8

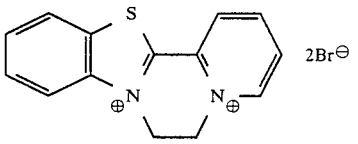

(V)-9

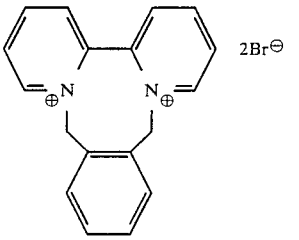

Practical examples of the compound shown by general formula (VI) are as follows:

(VI)-1

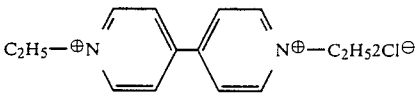

(VI)-2

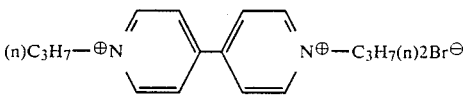

(VI)-3

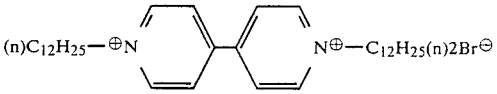

(VI)-4

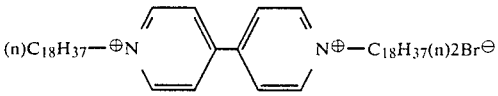

(VI)-5

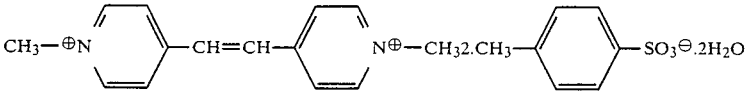

-continued (VI)-6

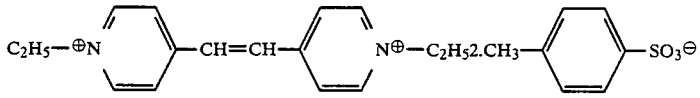

(VI)-7

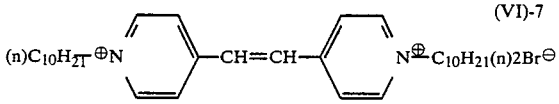

(VI)-8

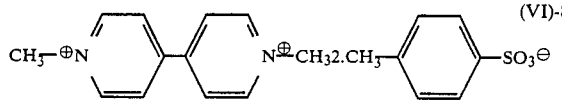

The compounds shown by general formulae (IV), (V) and (VI) are known compounds and are easily available or can be easily produced by the methods described in, for example, *Tetrahedron,* Vol. 24, pages 2699, 5433 and 6453, *Journal of Heterocyclic Chemistry,* Vol. 7, pages 719 and 401 (1970), ibid., Vol. 8, page 29 (1971), German Pat. No. 2,050,819, U.S. Pat. No. 3,124,458, etc.

Of the compounds shown by general formula (IV), (V) and (VI), the compounds of general formulae (IV) and (V) are more preferred and the compounds of general formula (V) are most preferred in this invention.

The compound shown by general formula (IV), (V) or (VI) is used in a range of 10 mg to 500 mg per mole of the silver halide in a direct positive silver halide emulsion layer.

At least one compound selected drom the compounds shown by general formula (I), (II) or (III) and at least one compound selected from the compounds shown by general formula (IV), (V) or (VI) are added to a silver halide emulsion as an aqueous solution or a solution in a water-miscible organic solvent, preferably low-boiling organic solvent at a proper step after desalting and before coating the silver halide emulsion, preferably after fog ripening. A part of the solution of both the foregoing compounds may be incorporated in a non-photosensitive hydrophilic colloid layer, for example, a protective layer.

The fogged direct positive reversal silver halide emulsion used in this invention is a photographic emulsion formed by dispersing a silver halide such as silver chloride, silver chlorobromide, silver chloroiodobromide, silver bromide, silver iodobromide, etc., in a solution of a protective colloid as will be described hereinafter. These silver halide emulsions are prepared by various methods such as, for example, a neutralization method, an ammonia method, an acid method or the method of using a thioether solvent as described in U.S. Pat. No. 3,574,628.

The original silver halide emulsion used for the direct positive silver halide photographic material of this invention is classified into the following two types.

The one is a silver halide emulsion wherein the silver halide has in the inside thereof a nucleus capable of trapping a free electron and the surface fogged optically or chemically. The feature of this type of original silver halide emulsion is in a point of directly giving a positive image by itself and by adding a sensitizing dye to the silver halide emulsion, not only a high sensitivity by the spectral sensitizing action but also a sensitization at a specific absorption region can be provided to the emulsion. For forming the free electron-trapped nuclei of this type of silver halide emulsion, a salt of a metal belonging to the group VIII of the Periodic Table is preferably used.

The other is a silver halide emulsion wherein the silver halide does not have in the inside thereof a free electron-trapping nucleus and has the surface fogged chemically. This type of original silver halide emulsion does not give a direct positive image by itself but gives a direct positive image by an organic desensitizer.

The original silver halide emulsions having free electron-trapping nuclei are described in Japanese Patent Publication Nos. 4125/68 and 29405/68, U.S. Pat. Nos. 2,401,051, 2,976,149 and 3,023,102, British Pat. Nos. 707,704 and 1,097,999, French Pat. Nos. 1,520,824 and 1,520,817, and Belgian Pat. Nos. 713,272, 721,567 and 681,768.

Also, the original silver halide emulsions having no free electron-trapping nuclei and organic desensitizers used for the emulsions are described in British Pat. Nos. 1,186,717, 1,186,714, 1,186,716 and 1,520,817, and U.S. Pat. Nos. 3,501,306, 3,501,307, 3,501,310 and 3,531,288.

Both types of the original silver halide emulsions classified into two types as described above can be used in this invention.

The silver halide photographic emulsion used in this invention is previously fogged optically or chemically as described above. As a chemical fogging agent used for fogging the photographic emulsion in this invention, there are, for example, hydrazine series derivatives, thiourea dioxide, formalin, amine borane, stannous chloride, etc. Also, the photographic silver halide emulsion can be fogged using a metal which is more electrically positive than silver, such as rhodium, gold, platinum, iridium, etc. The fogging extent for the direct positive reversal silver halide emulsion can be changed over a wide range and depends upon the composition and grain size of the silver halide used, the kind and concentration of the fogging agent used, the pH and pAg of the silver halide emulsion at fogging, and the fogging temperature and time. Practical procedures for fogging silver halide emulsions used in this invention are described in, for example, U.S. Pat. Nos. 3,867,149 and 3,062,652 and U.S. Pat. No. Re. 29,930 and Re. No. 29,974.

The silver halide photographic emulsions used in this invention may contain various compounds as described in *Research Disclosure,* Vol. 176, pages 22–31 (1979, November) as photographic additives. Examples of such photographic additives are stabilizers such as mercapto compounds, tetraazaindene compounds, etc.; hardening agents such as aldehyde series compounds, 2-hydroxy-4,6-dichloro-1,3,5-triazine series compounds, N-methylol compounds, vinyl sulfone series compounds, etc.; coating aids such as natural surface active agents (e.g., saponin, etc.), nonionic surface active agents (e.g., alkylene oxide series surface active agents, glycidol series surface active agents, etc.), anionic surface active agents having an acid group (e.g., a carboxylic acid group, a sulfonic acid group, a phosphoric acid group, a sulfuric acid ester group, a phosphoric acid ester group, etc.), and amphoteric surface active agents (e.g., amino acids, aminosulfonic acids, etc.); and polyalkylene oxide compounds acting as a gradation improving agent for lithographic development.

Also, for improving the dimensional stability of the silver halide photographic emulsion layer, a dispersion of a polymer which is insoluble or sparingly soluble in water may be incorporated in the silver halide emulsion. Examples of such a polymer are alkyl acrylate, alkyl methacrylate, alkoxyalkyl acrylate, alkoxyalkyl methacrylate, acrylamide, methacrylamide, vinyl esters (e.g., vinyl acetate), acrylonitrile, etc., and these polymers may be used solely or as a combination thereof. Practical examples of these polymers are described in U.S. Pat. Nos. 2,376,005, 2,739,137, 3,411,911, 3,488,708, 3,607,290, 3,635,715, etc.

For the silver halide photographic emulsions used in this invention, it is advantageous to use gelatin, in particular, gelatin which is inert to photographic property of the silver halide emulsion as a protective colloid but in place of gelatin, a photographically inert gelatin derivative (e.g., gelatin phthalide, etc.) or a water-soluble synthetic polymer (e.g., polyvinyl acrylate, polyvinyl alcohol, polyvinyl pyrrolidone, etc.) may be used.

The silver halide emulsion used in this invention is coated on an optional proper photographic support such as a glass plate, a film base (e.g., a cellulose acetate film, a cellulose acetate butyrate film, a polyester film such as a polyethylene terephthalate film, etc.), etc., to provide a direct positive silver halide photographic material of this invention.

The preferred silver coverage of the silver halide is in a range of 1 g/m$^2$ to 6 g/m$^2$.

Light exposure for obtaining a reversal image may be performed by an ordinary method. That is, the exposure may be performed using a known light source such as a tungsten lamp, a mercury lamp, a xenon arc lamp, a xenon flash lamp, etc.

For developing the direct positive silver halide photographic materials of this invention, an ordinary developing process as described in, for example, the foregoing *Research Disclosure* may be used but a so-called lith-type developing process (the "lith-type" developing process is a development process infectiously performing the development using usually a dihydroxybenzene (as a developing agent) under a low sulfite ion concentration for photographically reproducing a line image or photographically reproducing a halftone image by dot) or a so-called "super contrast" developing process performing the development in the presence of a hydrazide compound as described in Japanese Patent Application (OPI) No. 37732/79 (the term "OPI" indicates an unexamined published patent application open to public inspection), U.S. Pat. No. 4,221,857, etc., can also be used.

The invention will now be explained more practically by the following examples. However, the scope of the invention is not limited to these examples.

EXAMPLE 1

A gelatino silver bromide emulsion having a mean grain size of about 0.2 micron was prepared by simultaneously adding an aqueous solution of potassium bromide and an aqueous solution of silver nitrate to an aqueous gelatin solution under stirring at 65° C. over a period of about 60 minutes. After removing salts from the silver halide emulsion by a flocculation method using a polyvalent anionic polymer and adjusting the pH of the emulsion to 10, hydrazine was added to the emulsion in an amount of 25 mg per mole of silver in the emulsion followed by heating to 65° C. for 70 minutes to fog the silver halide emulsion. Then, the silver halide emulsion was divided into equal parts. After adding to each emulsion 6-ethoxy-1-methyl-2-(3-nitrostyryl)-quinolinium methylsulfate as an electron acceptor in an amount of 500 mg per mole of silver, the phenazine series compound of general formula (I) or (II) and the nitroindazole series compound of general formula (IV) dissolved in methanol were added to the silver halide emulsion according to this invention as shown in Table 1(a). Each of the silver halide emulsions thus prepared was coated on a cellulose triacetate film at a silver coverage of 3 g/m$^2$, whereby coated Samples 1 to 9 were obtained.

Each sample was exposed to a mercury lamp through an optical wedge, developed in a developer having the composition shown below for 3 minutes at 20° C., and then fixed to provide a film strip. The density of each film strip thus obtained was measured using a P-type densitometer (made by Fuji Photo Film Co., Ltd.) to provide each characteristic curve. The results of the sensitometry are also shown in Table 1(a).

| Composition of the Developer: | |
|---|---|
| Metol | 3.1 g |
| Sodium sulfite | 45 g |
| Hydroquinone | 12 g |
| Sodium carbonate | 79 g |
| Potassium bromide | 1.9 g |
| Water to make | 1 liter |

In order to illustrate the type of original silver halide emulsion having a free electron-trapping nucleus in the silver halide grain, the following experiment was also performed. A silver bromide emulsion having a mean grain size of about 2 microns was prepared by simultaneously adding an aqueous solution of potassium bromide and an aqueous solution of silver nitrate to an aqueous gelatin solution with stirring in the presence of a rhodium salt at 65° C. over a period of about 60 minutes and then the same fogging procedure as above was applied to the silver halide emulsion. The silver halide emulsion was then divided into equal parts. After adding to each of the silver halide emulsions a methanol solution of the phenazine series compound of general formula (I) or (II) and the nitroindazole series compound of general formula (IV) as shown in Table 1(b), each emulsion was coated on a cellulose triacetate film at a silver coverage of 3 g/m$^2$, whereby Samples 10 to 18 were prepared. Each sample was exposed to a mercury lamp through an optical wedge, developed by the developer having the same composition as above, and fixed to provide a film strip. The density measurement was performed on each film strip as in the above procedure and the results obtained are shown in Table 1(b).

TABLE 1(a)

| No. | Addition Compound (mg/mole-Ag) | | Gamma | Maximum Density | Minimum Density |
|---|---|---|---|---|---|
| 1 | — | — | 3.9 | 5.1 | 0.13 |
| 2 | (I)-3 (50 mg) | — | 4.0 | 5.0 | 0.11 |
| 3 | — | (IV)-1 (100 mg) | 4.0 | 5.1 | 0.13 |
| 4 | (I)-3 (50 mg) | (IV)-1 (100 mg) | 4.1 | 5.1 | 0.09 |
| 5 | (I)-3 (100 mg) | (IV)-1 (100 mg) | 4.0 | 5.1 | 0.08 |
| 6 | (II)-5 (50 mg) | — | 4.0 | 5.1 | 0.11 |
| 7 | — | (IV)-2 (50 mg) | 4.0 | 5.1 | 0.13 |

TABLE 1(a)-continued

| No. | Addition Compound (mg/mole-Ag) | | Gamma | Maximum Density | Minimum Density |
|---|---|---|---|---|---|
| 8 | (II)-5 (50 mg) | (IV)-2 (50 mg) | 4.0 | 5.1 | 0.08 |
| 9 | (II)-5 (50 mg) | (IV)-2 (100 mg) | 3.9 | 5.1 | 0.08 |

TABLE 1(b)

| No. | Addition compound (mg/mole-Ag) | | Gamma | Maximum Density | Minimum Density |
|---|---|---|---|---|---|
| 10 | — | — | 4.0 | 5.2 | 0.13 |
| 11 | (I)-3 (20 mg) | — | 4.0 | 5.2 | 0.12 |
| 12 | — | (IV)-1 (100 mg) | 4.1 | 5.2 | 0.13 |
| 13 | (I)-3 (20 mg) | (IV)-1 (100 mg) | 4.0 | 5.2 | 0.07 |
| 14 | (I)-3 (40 mg) | (IV)-1 (100 mg) | 4.0 | 5.2 | 0.06 |
| 15 | (II)-6 (40 mg) | — | 4.0 | 5.2 | 0.11 |
| 16 | — | (IV)-2 (50 mg) | 4.0 | 5.2 | 0.13 |
| 17 | (II)-6 (40 mg) | (IV)-2 (50 mg) | 4.1 | 5.2 | 0.09 |
| 18 | (II)-6 (40 mg) | (IV)-2 (100 mg) | 4.1 | 5.2 | 0.09 |

As shown in Tables 1(a) and 1(b), Samples 4, 5, 8, 9, 13, 14, 17 and 18 of this invention using the compound of general formula (I) or (II) and the compound of general formula (IV) give very low minimum density as compared with that of comparison examples, Samples 2, 3, 6, 7, 11, 12, 15 and 16.

EXAMPLE 2

By following the same procedure as in Example 1 except that the bispyridinium salt series compounds of general formula (V) or (VI) as shown in Tables 2(a) and 2(b) were used in place of the nitroindazole compounds of general formula (IV) and the phenazine series compounds of general formula (I), (II) or (III) as shown in Tables 2(a) and 2(b) were used, Samples 101 to 124 were prepared and the same sensitometry as in Example 1 was performed. The results are shown in Tables 2(a) and 2(b). In this case, Samples 113 to 124 in Table 2(b) were the examples of using silver halide emulsions each having a free electron-trapping nucleus (Rh) in the inside of the silver halide grain as the original silver halide emulsions.

TABLE 2(a)

| No. | Addition Compound (mg/mole-Ag) | | Gamma | Maximum Density | Minimum Density |
|---|---|---|---|---|---|
| 101 | — | — | 4.0 | 5.2 | 0.13 |
| 102 | (I)-3 (50 mg) | — | 4.0 | " | 0.11 |
| 103 | (I)-3 (100 mg) | — | 4.0 | " | 0.10 |
| 104 | — | (V)-1 (50 mg) | 4.3 | " | 0.09 |
| 105 | — | (V)-1 (100 mg) | 4.3 | " | 0.09 |
| 106 | (I)-3 (100 mg) | (V)-1 (50 mg) | 4.5 | " | 0.06 |
| 107 | (I)-3 (100 mg) | (V)-1 (100 mg) | 4.5 | " | 0.05 |
| 108 | (II)-5 (100 mg) | — | 4.2 | " | 0.11 |
| 109 | (II)-5 (100 mg) | (V)-1 (50 mg) | 4.5 | " | 0.06 |
| 110 | (II)-5 (100 mg) | (V)-1 (100 mg) | 4.5 | " | 0.06 |
| 111 | (II)-5 (100 mg) | (VI)-5 (100 mg) | 4.5 | " | 0.07 |
| 112 | (III)-1 (100 mg) | (V)-1 (100 mg) | 4.5 | " | 0.06 |

TABLE 2(b)

| No. | Addition Compound (mg/mole-Ag) | | Gamma | Maximum Density | Minimum Density |
|---|---|---|---|---|---|
| 113 | — | — | 4.0 | 5.1 | 0.13 |
| 114 | (II)-5 (50 mg) | — | 4.0 | 5.1 | 0.11 |

TABLE 2(b)-continued

| No. | Addition Compound (mg/mole-Ag) | | Gamma | Maximum Density | Minimum Density |
|---|---|---|---|---|---|
| 115 | (II)-5 (100 mg) | — | 4.0 | 5.1 | 0.11 |
| 116 | — | (V)-1 (50 mg) | 4.3 | 5.1 | 0.10 |
| 117 | — | (V)-1 (100 mg) | 4.3 | 5.1 | 0.10 |
| 118 | (II)-5 (100 mg) | (V)-1 (50 mg) | 4.5 | 5.1 | 0.06 |
| 119 | (II)-5 (100 mg) | (V)-1 (100 mg) | 4.5 | 5.1 | 0.05 |
| 120 | (II)-6 (100 mg) | — | 4.1 | 5.1 | 0.12 |
| 121 | — | (V)-3 (100 mg) | 4.3 | 5.1 | 0.11 |
| 122 | (II)-6 (100 mg) | (V)-3 (100 mg) | 4.5 | 5.1 | 0.07 |
| 123 | (II)-5 (100 mg) | (VI)-5 (100 mg) | 4.5 | 5.1 | 0.06 |
| 124 | (II)-1 (100 mg) | (V)-1 (100 mg) | 4.5 | 5.1 | 0.05 |

As shown in Tables 2(a) and 2(b), it is understood that Samples 106, 107, 109, 110, 111, 112, 118, 119, 122, 123 and 124 of this invention using the phenazine series compounds of general formula (I), (II) or (III) and the bispyridinium salt series compounds of general formula (V) or (VI) give high contrast and very low minimum density as compared to those of comparison examples, Samples 102, 103, 104, 105, 108, 114, 115, 116, 117, 120 and 121.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic material, comprising:

a support base having thereon:

a silver halide emulsion layer containing previously surface fogged silver halide grains and a compound represented by a general formula selected from the group consisting of (I), (II) and (III) and a compound represented by a general formula selected from the group consisting of (IV), (V) and (VI):

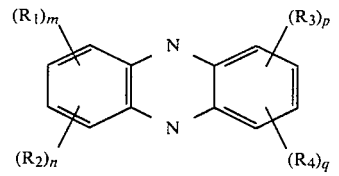

(I)

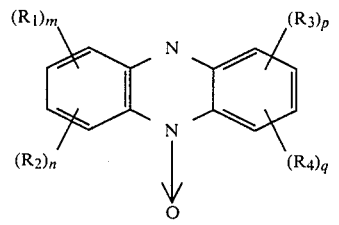

(II)

-continued (III)

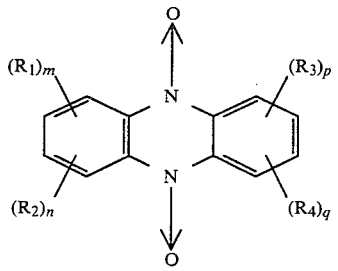

wherein $R_1$ to $R_4$, which may be the same or different, each represents a hydrogen atom, an alkyl group, an aryl group, a halogen atom, an alkoxy group, a hydroxy group, an acylamino group, a carboxy group, a nitro group, or a cyclic hydrocarbon condensed to a benzene ring; and m, n, p and q each represents 1, 2 or 3, (IV)

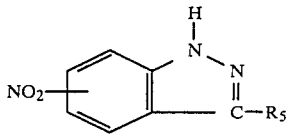

wherein $R_5$ represents a hydrogen atom or an alkyl group having 1 to 5 carbon atoms and $NO_2$ may be positioned at 5-position, 6-position or 7-position, (V)

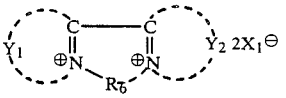

wherein $Y_1$ and $Y_2$, which may be the same or different, each represents a non-metallic atomic group necessary for completing a pyridine ring, a benzothiazole ring, or a benzimidazole ring; and $Y_1$ and $Y_2$ may combine with each other to form a 1,10-phenanthroline ring; $R_6$ represents $-(CH_2)_{m_1}$ (wherein $m_1$ represents 2, 3 or 4), —CH=CH—, or

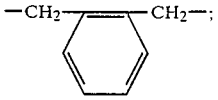

and $X_1$ represents an anion, (VI)

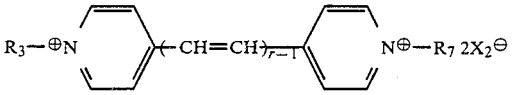

wherein $R_7$ represents an alkyl group; r represents 1 or 2, and $X_2$ represents an anion;

wherein compounds represented by formulae (I), (II), (III), (IV), (V) and (VI) are present in an amount sufficient to reduce $D_{min}$ without reducing the contrast of an image formed by developing the silver halide photographic material.

2. A material as claimed in claim 1, wherein $R_1$ to $R_4$ each represents a hydrogen atom, an alkyl group containing 1 to 4 carbon atoms, an aryl group containing 6 to 10 carbon atoms, a halogen atom, an alkoxy group containing 1 to 4 carbon atoms, a hydroxy group, an acylamino group containing 1 to 4 carbon atoms, a carboxy group, a nitro group, or a cyclic hydrocarbon group condensed to a benzene ring.

3. A material as claimed in claim 1, wherein $R_1$ to $R_4$ each represents a hydrogen atom, an alkyl group, halogen atom, an alkoxy group, a nitro group or a hydroxy group.

4. A material as claimed in claim 1, wherein the compound represented by a general formula selected from the group consisting of (IV), (V) and (VI) is a compound represented by the general formula (IV) or (V).

5. A material as claimed in claim 1, wherein the compound represented by a general formula selected from the group consisting of (IV), (V) and (VI) is a compound represented by the general formula (V).

6. A material as claimed in claim 1, wherein the compound represented by the general formula selected from the group consisting of (I), (II) and (III) is present in an amount in the range of 5 mg to 500 mg per mole of silver halide.

7. A material as claimed in claim 6, wherein the compound represented by the general formula selected from the group consisting of (I), (II) and (III) is present in an amount in the range of 20 mg to 200 mg per mole of silver halide.

8. A material as claimed in claim 1, wherein the compound represented by a general formula selected from the group consisting of (IV), (V) and (VI) is present in an amount in the range of 10 mg to 500 mg per mole of silver halide.

9. A material as claimed in claim 1, wherein the silver halide is present in an amount in the range of 1 $g/m^2$ to 6 $g/m^2$.

10. A material as claimed in claim 3, wherein said alkyl group contains 1 to 4 carbon atoms and said alkoxy group contains 1 to 4 carbon atoms.

11. A material as claimed in claim 1, wherein said silver halide emulsion contains silver halide grains having free electron trapping nuclei.

* * * * *